United States Patent [19]

Stucky

[11] 4,023,315

[45] May 17, 1977

[54] PREFABRICATED BUILDINGS

[75] Inventor: Fritz Christophe Stucky, Zug, Switzerland

[73] Assignee: Elcon A.G., Zug, Switzerland

[22] Filed: Nov. 4, 1971

[21] Appl. No.: 195,882

Related U.S. Application Data

[63] Continuation of Ser. No. 844,384, July 24, 1969, abandoned.

[30] Foreign Application Priority Data

June 7, 1969 United Kingdom ..... 28917/69
July 26, 1968 United Kingdom ..... 35710/68

[52] U.S. Cl. ..... 52/79.13; 52/234; 52/236.3; 52/745; 52/127; 52/227

[51] Int. Cl.[2] ..... E04H 1/04; E04B 1/343; E04C 3/20

[58] Field of Search ..... 52/223, 227–229, 52/231, 79, 234, 236, 127

[56] References Cited

UNITED STATES PATENTS

| | | | |
|---|---|---|---|
| 2,691,291 | 10/1954 | Henderson | 52/79 |
| 3,260,025 | 7/1966 | Van Der Lely | 52/228 |
| 3,377,755 | 4/1968 | Stucky et al. | 52/236 |
| 3,455,075 | 7/1969 | Frey | 52/79 |
| 3,503,170 | 3/1970 | Shelley | 52/79 |
| 3,526,067 | 9/1970 | Furter et al. | 52/236 |
| 3,564,795 | 2/1971 | Henton | 52/227 |
| 3,568,380 | 3/1971 | Stucky | 52/79 |
| 3,744,200 | 7/1973 | Rice | 52/227 |

FOREIGN PATENTS OR APPLICATIONS

| | | | |
|---|---|---|---|
| 1,568,176 | 4/1969 | France | 52/126 |
| 823,652 | 12/1951 | Germany | |
| 865,652 | 2/1953 | Germany | 52/79 |
| 612,667 | 11/1960 | Italy | 52/227 |
| 603,695 | 6/1948 | United Kingdom | 52/236 |

*Primary Examiner*—Price C. Faw, Jr.
*Assistant Examiner*—James L. Ridgill, Jr.
*Attorney, Agent, or Firm*—Brumbaugh, Graves, Donohue & Raymond

[57] ABSTRACT

The invention concerns prefabricated buildings built up of transportable prefabricated room elements each being a cell-like structure having four faces and comprising a floor panel, load-bearing columns attached thereto, and a roof or ceiling supported by the columns. In one construction in which the columns are provided at corners of the floor panel, one corner is void of a column so that when the room elements are mounted face to face, with the column-less corners meeting, an unobstructed floor area results. In another construction, a column is omitted at an intermediate point in the length of one face. The room elements are constructed at a factory, and a temporary support is inserted at each location at which a column is omitted. The room elements are transported from the factory to the building site and there assembled face to face into storeys of a building in which the room elements of each upper storey are supported on the columns and temporary supports of the room elements of the next lower storey. At or near to each temporary support, adjacent floor panels are then connected by a reinforcing element which extends across the front between them so as to support or render these floor panels mutually-supporting as in a structural whole, after removal of the temporary supports. Only when this reinforcing elements has been provided, are the temporary supports removed.

21 Claims, 42 Drawing Figures

11
11
10a
11
12

11
12
10b
11
12

11a
11
11
10c
11
12
11a
11a 11
12
10d
11
12
11a 11a
11
11
10e
11
12
11

12
11
11
10f
11
12
11

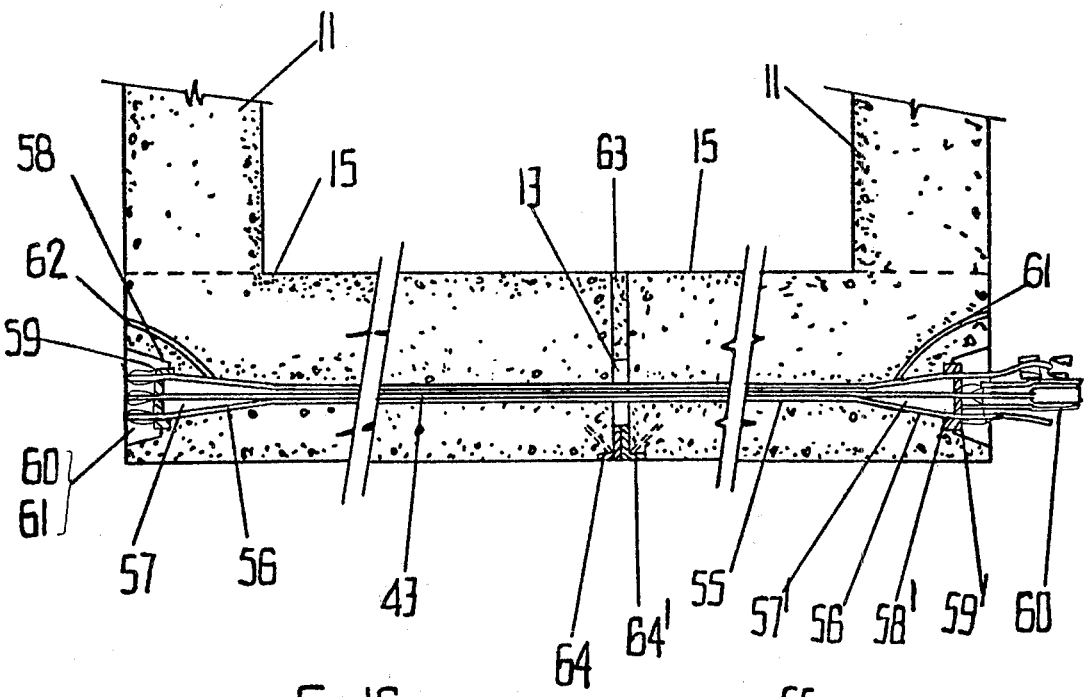
FIG 16
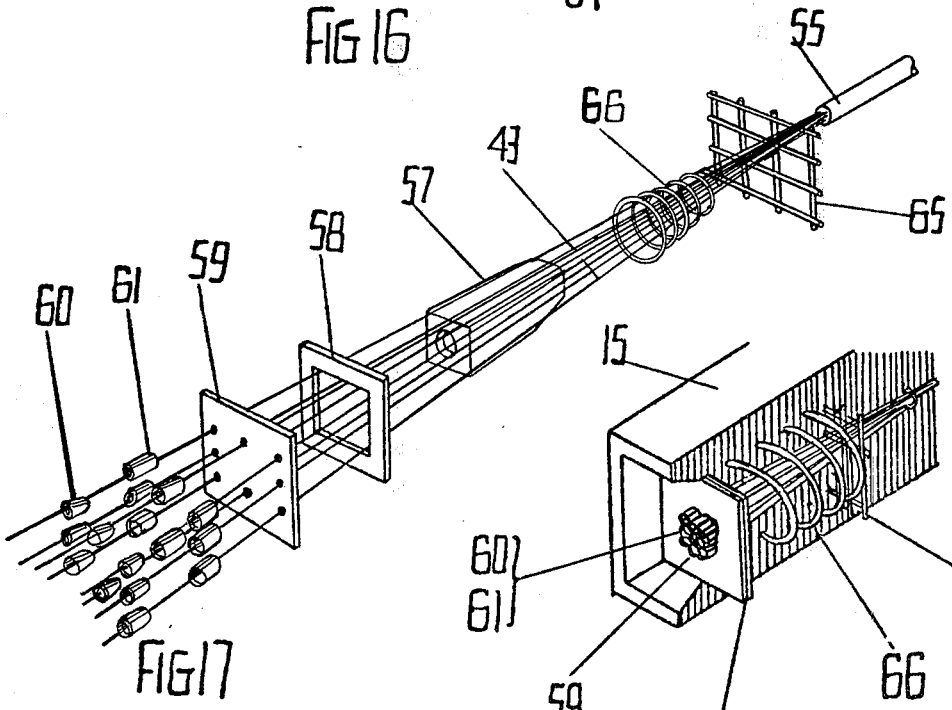
FIG17
FIG.18.

PREFABRICATED BUILDINGS

CROSS REFERENCES TO RELATED APPLICATION

This is a continuation, of application Ser. No. 844,384 filed July 24, 1969 now abandoned.

British No. 35710/68 of July 26, 1968, Elcon A. G., from which priority is claimed.

British No. 28917/69, of June 7, 1969 Elcon A. G. divided out of No. 35710/68 and having the effective date of July 26, 1968.

This invention relates to prefabricated buildings comprising transportable prefabricated room elements and their method of construction, and is particularly concerned with plural storey buildings and primarily those having at least three storeys. Reference may be had to the room elements and building structures that are the subject matter of British Patent Specifications Nos. 1,101,597; 1,101,385; 1,068,172; 1,027,241; 1,027,242; and 1,034,101, and also of co-pending British Pat. Application No. 51155/67, to which reference may be made for further particulars for background information about the basic building system with which this invention is concerned.

In the specific constructions described and illustrated in the published Patent Specifications aforesaid, buildings are constructed from transportable prefabricated room elements, each of which has a floor panel and a column at each corner of the floor panel. In the erection of a storey of a building the room elements are assembled in ranks and files:- each rank consisting of a succession of room elements mounted side-by-side and each file consisting of a succession of the room elements mounted end-to-end. It would be possible to construct the room elements with at least one open side and at least one open end and to assemble them in ranks and files in such a manner that, in at least one group consisting of room elements belonging to at least two adjacent ranks and to at least two adjacent files, the room elements of each rank are mounted open side to open side and those of each file are mounted open end to open end, thereby providing an open floor area which is not sub-divided by side walls and end walls of the adjacent elements. In such a group assembly, at a location where corners of four room elements meet there would be a cluster of four columns, and this cluster would constitute a local obstruction in the otherwise-open floor plan. It will be appreciated that the number of such locations in a given floor area depends on the number of room elements in the ranks and files. In some buildings, where an open floor area of considerable expanse is required, such an obstruction is (or obstructions are) undesirable and an object of this invention is to overcome this drawback.

Therefore, the present invention provides a building having a storey comprising at least two adjoining transportable prefabricated room elements as hereinbefore defined, where a) said adjoining room elements have adjoining open faces at which they are mounted face-to-face, b) these adjoining room elements conjointly provide an open floor area which extends across the joint between them and is uninterrupted by a vertical load-bearing structure aforesaid, c) these adjoining room elements have the aforesaid load-bearing structures at the perimeter of said open floor area, d) these perimeter load-bearing structures support parts of the building extending over and positioned above said open floor area and e) the floor panels of said adjoining room elements are supported by a reinforcing element extending across said joint. The expression "reinforcing element" means a structural element which is capable of taking up bending forces, exercised by the live and dead loads imposed on adjoining floor panels, at a location where these floor panels are otherwise unsupported, and which is provided during the erection of the building. This reinforcing element may also be capable of taking up tension/forces across the joint.

Although the invention is applicable to a single storey building, yet in an important application of the invention the storey above referred to is an upper storey superimposed upon a lower storey which also comprises transportable prefabricated room elements as hereinbefore defined.

Since the room elements are transportable, it is necessary that the connection afforded by the reinforcing element above-mentioned shall be effected at the building site subsequent to the assembly of the room elements face-to-face.

The reinforcing element may be provided in any of the following ways:- a) by rigidly joining internal reinforcements of adjacent floor panels at the joint, b) by tensioning adjacent floor panels together by tensioning cables or the like in such manner as to resist downward deflection at the joint between adjacent panels, c) by an added support beam which extends across the joint between adjacent panels (and which may be connected to the latter) or d) by employing an added support structure of inverted U-shape comprising two pillars connected by a cross beam which structure spans said open floor area and supports the roof or ceiling panels of the adjacent room elements from their floor panels and/or provides support for the floor panels of superimposed room elements.

In an important application of the present invention there is a group of four of the said room elements, each having a load-bearing column at least at two of its corners and having a corner which is void of such a column, these four room elements are mounted face-to-face with their columnless corners meeting, and the reinforcing element is provided in the region of the columnless corners.

It is intended that the room element shall be prefabricated to a substantially final stage of construction under factory conditions at a location remote from the building site. In particular such electrical, plumbing, and heating installations, doors, partitions, glazing, and interior finish, as are required may be applied to the room elements at that location so as to bring them to a substantially finished condition. The room elements are then transported to the building site and there assembled into a building to which only the minimum of finishing work, such for example as concealing joint lines and the assembly and connection of the services, needs to be carried out.

Therefore, the present invention also provides a method of building which comprises a) prefabricating, at a location other than the building site, a plurality of transportable prefabricated room elements as hereinbefore defined, at least two of which room elements have an open face which is devoid of a load-bearing structure aforesaid, b) transporting these room elements to the building site, c) at that site, mounting the said open-face room elements open-face-to-open-face, whereby their adjacent floor panels conjointly form an open floor area which is devoid of any load-bearing structure aforesaid at the joint between them and has said structures at the perimeter of said open space and d) during the course of erection, providing said adjacent floor panels with a reinforcing element extending across the joint. According to a very important subsidiary feature of the invention, this method further comprises e) providing each open-faced room element during construction of the latter with a temporary vertical load-bearing support standing on its floor panel at a location in a margin of the panel which is devoid of any load-bearing structure aforesaid, f) retaining the temporary supports in position during transport of the room elements to the building site and g) removing the temporary supports before or after the reinforcing element has been provided.

In the case of a plural storey building in which the room elements of each upper storey rest, directly or indirectly, on the room elements of the next lower storey, the room elements of all the storeys are assembled with the temporary supports in position and these temporary supports are removed storey by storey working downwards from the top storey. In order to facilitate lifting the room elements, each temporary support may be provided with an attachment device for a lifting tackle.

In order that the invention may be better understood, reference will now be made to the accompanying drawings, in which:

FIGS. 1A–1F are diagrams illustrating in plan various forms of room elements according to the present invention, FIGS. 2A–2I are diagrams illustrating in plan various ways in which these room elements may be assembled face-to-face, FIG. 3 is a perspective view of a complete room element according to this invention with a temporary support in position, FIGS. 4 and 5 are perspective views showing two arrangements wherein the reinforcing element is a beam, FIG. 6 is a perspective view showing an alternative form of reinforcing element, comprising casting in beams, and the way in which it is completed, FIG. 7 is a longitudinal section, illustrating a thermite welding process, FIG. 8 is a longitudinal section showing the joint between the beams in FIG. 6, FIG. 9 is a width-wise cross section through one of the floor panels in FIGs. 6-8, FIG. 10 shows a modification of the arrangement shown in FIG. 6, FIG. 11 shows an alternative to FIg. 6, in which the reinforcing element is provided by connecting integral reinforcement rods of the adjacent floor panels, FIG. 12 is a diagram illustrating an arrangement in which the adjacent floor panels are connected by prestressing cables, FIG. 13 illustrates one way in which pre-stressing cables of two adjacent room elements may be connected together to post-stress these two elements together, FIGS. 14 and 15 show a temporary anchorage for a prestressing cable, FIG. 16 is a widthwise cross section through two adjacent floor panels showing their connection by post-tensioning cables, FIG. 17 is an exploded view showing the arrangement of the cables, FIG. 18 is a perspective view showing an end of the cables in situ, FIG. 19 shows a temporary support in position in a room element, FIG. 20 is an exploded view illustrating the temporary supports in two superimposed room elements, FIG. 21 is a sectional elevation of two storeys showing the temporary supports in position in the lower storey, FIGS. 22A–22C are diagrams illustrating one way of assembling the room elements, with the temporary supports, FIGS. 23A–23D are diagrams illustrating an alternative mode of assembly, FIG. 24 is a plan view of the upper floors of two apartments.

In FIG.1A the floor panel of the room element 10*a* has a vertical load-supporting column 11 at each of three corners, whereas one corner is void of such a column, but is provided with a temporary support 12. In FIG. 1B there are corner columns 11 at one end or first face of the floor panel of room element 10*b*, while the other two corners are void of columns and are each provided with a temporary support 12. FIG. 1C illustrates a construction applicable to a long room element 10*c*, this room element having one columnless corner, columns 11 at three of the corners, and an intermediate column 11*a* at an intermediate location in the length of each long side. FIG. 1D shows a construction in which both corners at one end of the long room element 10*d* are void of the column 11. In FIG. 1E, the room element 10*e* has a column 11 at each corner of the floor panel, but only one long side is provided with an intermediate column 11*a*, the other long side being provided with a temporary support 12. In FIG. 1F, room element 10*f* has a column 11 at each corner and a temporary support 12 at an intermediate point in the length of each long side.

In the case of the room element according to FIGS. 1A–1D, it is intended that that room element shall be open at least at one of the two faces which meet at a columnless corner. In the case of a room element according to FIG. 1E or FIG. 1F, the latter is open at the long side, or each long side, which is void of an intermediate column 11*a*.

The two columns at an end (i.e. the two corners) of each room element may be comprised in a vertical load-bearing end structure as described in British Specification No. 1,068,172. This end structure may be permanently fixed to the end of the floor panel as described in British Specification No. 1,109,873 and the joint may be as described in British Specification No. 1,101,597. Alternatively, these corner columns may be initially separate from each other although conjointly forming a load-bearing end structure when fixed to the floor panel. In the case of such an initially separate corner column and in the case of an intermediate column 11*a*, that column may also be permanently fixed to the floor panel substantially as described in these Specifications.

FIG. 2A shows that a room element 10*a* may be mounted open-side-to-open-side with another room element 10*a'* which is a mirror image of it, the joint face being indicated at 13. Thus, these two room elements conjointly provide an open floor area extending across the joint. FIG. 2B shows how a still greater uninterrupted floor area may be provided by mounting three room elements 10*a*, 10*b*, 10*a'* open-face-to-open-face.

In general in the erection of a storey of a building the room elements will be assembled in ranks and files, each rank consisting of a succession of room elements mounted side-by-side and each file consisting of a succession of room elements mounted end-to-end. Thus in FIGS. 2C–2H two successive ranks are indicated at A,B etc. and successive files at *a*, *b* etc., it being understood that an assembly may consist of any desirable number of ranks and any desirable number of files.

Figure 2A:
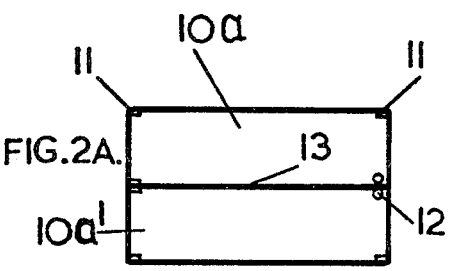
FIG. 2C shows how four room elements, each having at least one open side and at least one open end and a corner which is void of a column 11, mounted open-side to open-side and open-end to open-end, so that the four columnless corners meet, the joint face betweenn the open ends being indicated at 14. In effect, this is a duplication of the arrangement shown in FIG. 2A.
FIG. 2D shows how an assembly of six room elements comprising two of each of elements 10*a*, 10*b* and 10*a'* may be arranged.
FIG. 2E shows how four room elements consisting of two room elements 10*c* and two other room elements 10*c'* that are mirror images thereof may be arranged open-side to open-side and open-end to open-end with the columnless corners meeting.
Figure 2C:
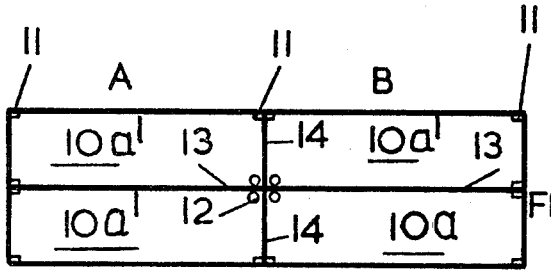
Figure 2B:
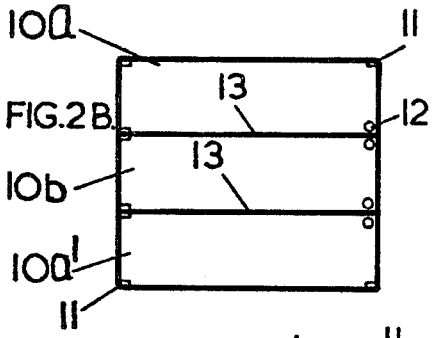
Figure 2D:
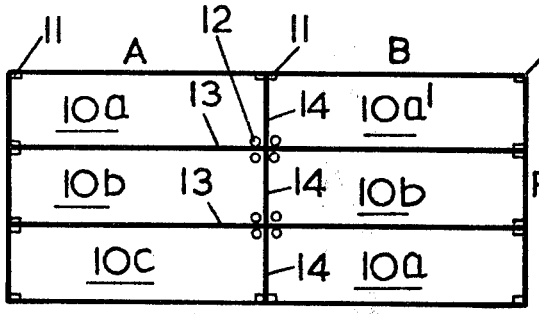
Figure 2E:
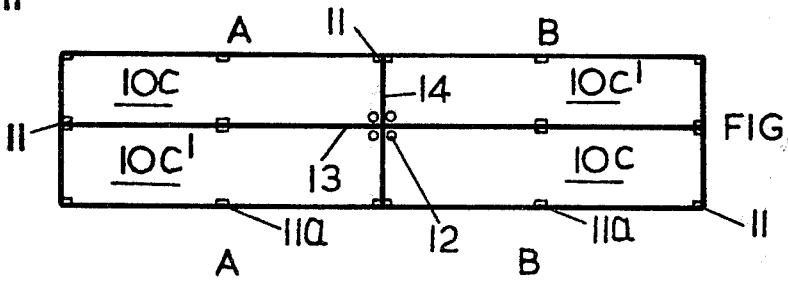
Figure 2F:
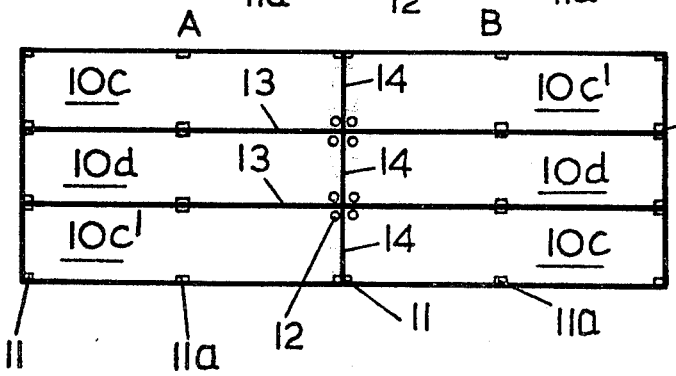

FIG. 2F shows a group of six room elements mounted open-side to open-side and open-end to open-end, this group consisting of two room elements 10*c*, two room elements 10*c'* that are mirror images thereof, and two intermediate room elements 10*d*.

Figure 2G:
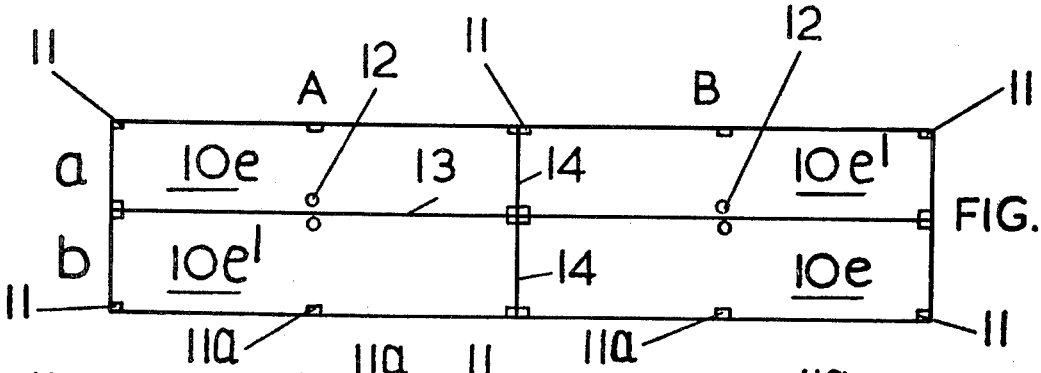

FIG. 2G shows a group of four room elements mounted open-side to open-side and open-end to open-end and consisting of two room elements 10*e* and two room elements 10*e'* that are mirror images thereof.

Figure 2H:
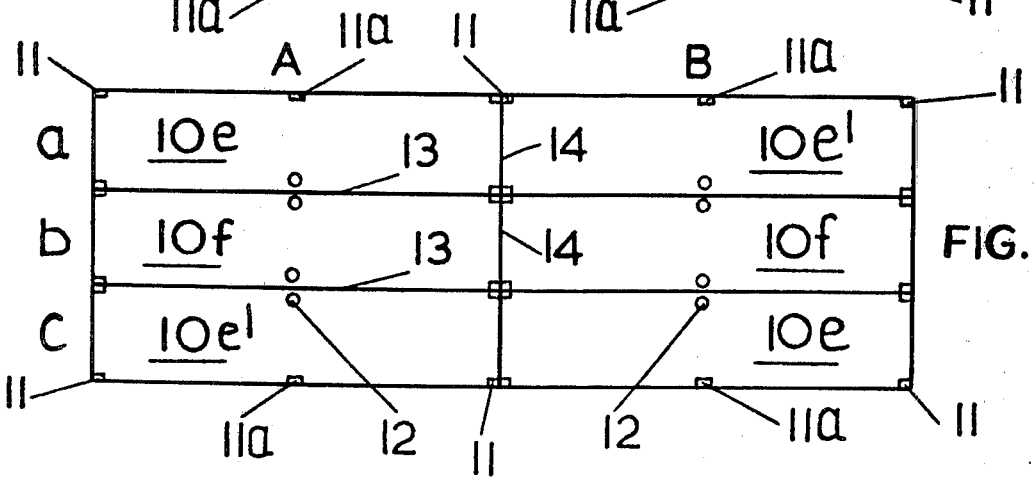

FIG. 2H shows a group of six elements in which a room element 10*f* is interposed, in each rank, between room elements 10*e*, 10*e'* .

Figure 2I:
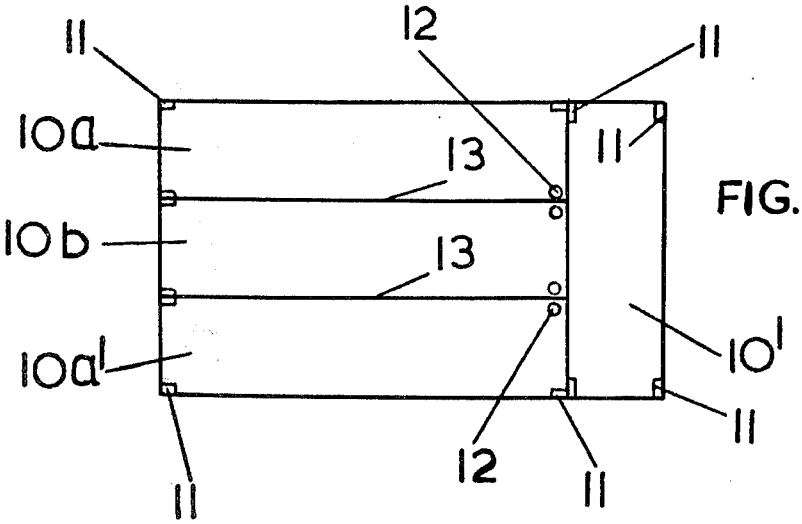

FIG. 2I illustrates the fact that the room elements may be mounted open-end to open-side, the open ends of the open-sided room elements 10*a*, 10*b*, 10*a'* being position against an open side of room element 10, which in this example has a column 11 at each corner.

It will be observed that in each of FIGS. 1A–2I, the temporary supports 12 are indicated by circles. The space between adjacent columns 11, at an end face or side face of the room element, may be occupied by fill-in panelling. Alternatively, instead of columns 11 there may be load-bearing wall at an end face or side face of the room element.

Figures 1A, 1B, 1C, 1D, 1E, 1F:
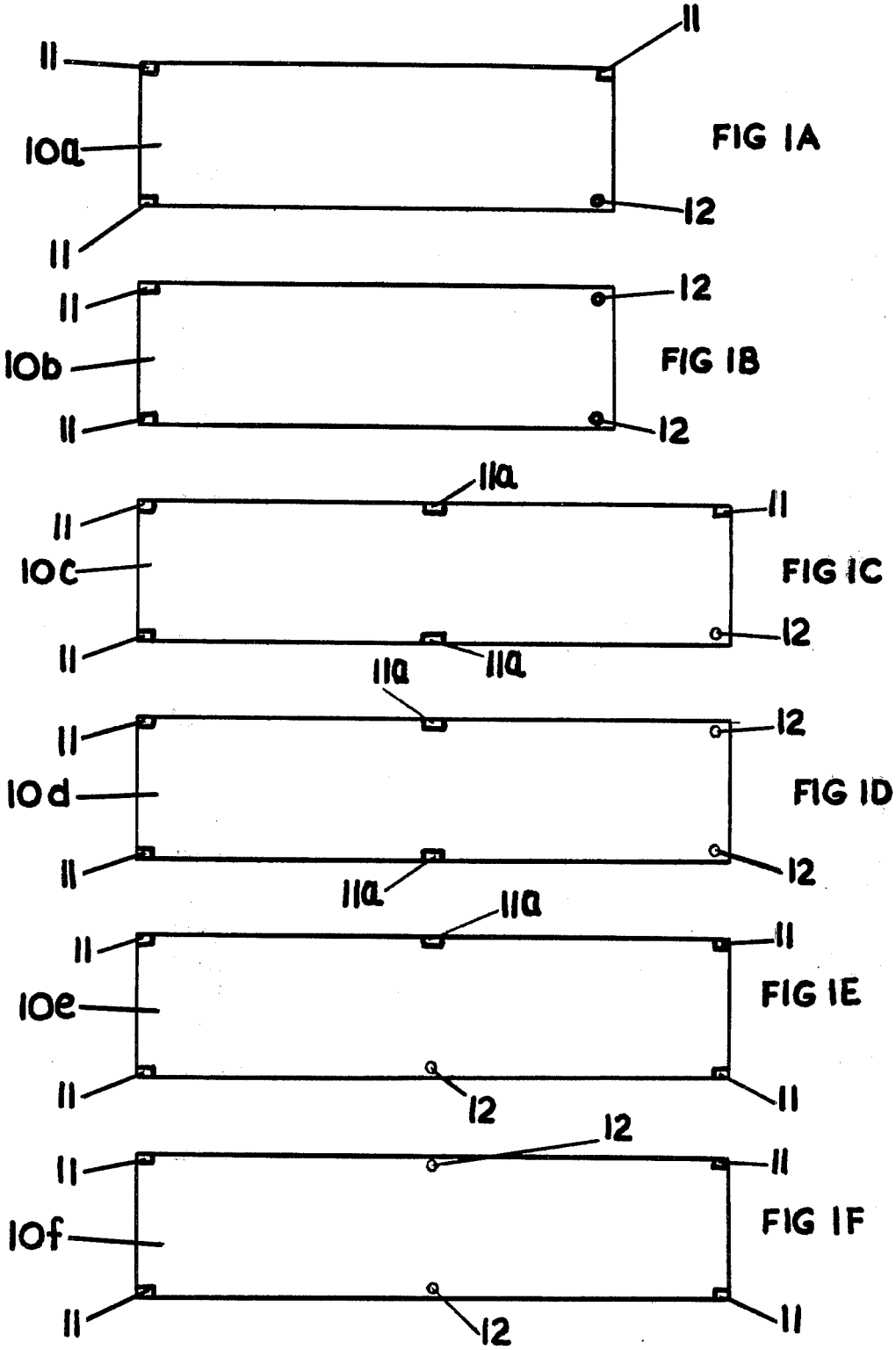
Figure 3:
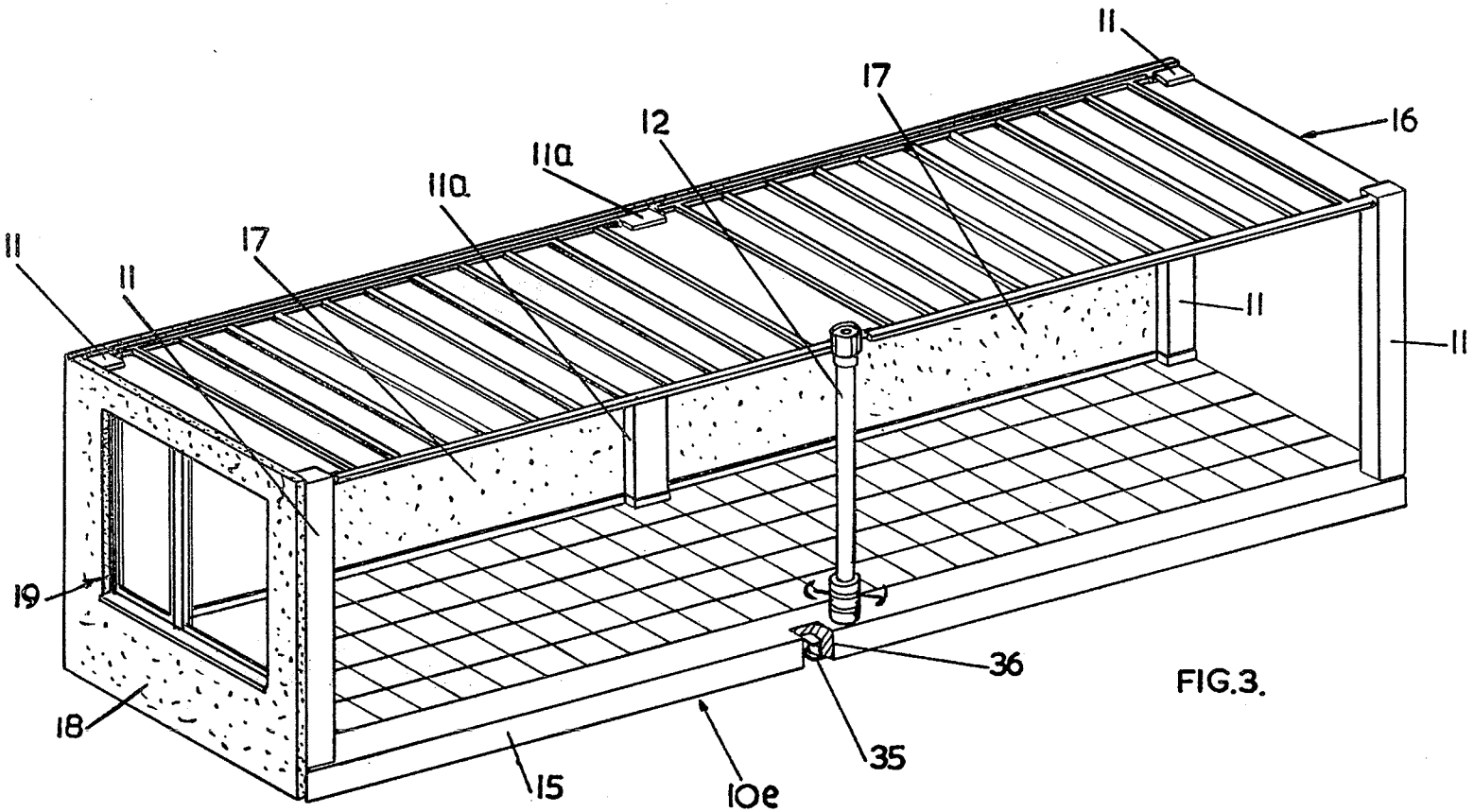

FIG. 3 shows a finished room element, and for the sake of example, this is shown as being a room element of the variety shown at 10*e* in FIG. 1E. It has a rigid floor panel 15 with a vertical load-bearing column 11 at each of its four corners and a vertical load-bearing column 11*a* midway in the length of one long side. These columns support the ceiling panel 16. The front face and right-hand end face of the room element are open. The rear face may be closed by fill-in panelling 17 attached to the columns 11 and 11*a* at that face. The left-hand end face is closed by fill-in panelling 18 attached to the end columns 11, which fill-in panelling incorporates a window 19. It will be understood, however, that the fill-in panelling 17 may incorporate one or more windows or a door and the fill-in panelling 18 may incorporate a door instead of a window, the distance between adjacent columns being at least sufficient to accommodate a door or window.

Since the open long face of the room element is devoid of an intermediate column 11*a*, it is provided with the temporary support column 12 which serves to support the roof panel 16 from the floor panel and also during erection of the building, affords support for the floor panel of a superimposed room element.

It is to be emphasised that during the manufacture of each room element which is void of a column at one or more corners or at an intermediate location in the length of one long face, a temporary support 12 must be introduced. This support temporarily fulfils all the functions of the missing column. It is retained during transport of the room elements and their erection into the building and is only removed after adjacent room elements, superimposed thereon, are so structurally connected together as in effect to constitute a single room element.

Figure 20:
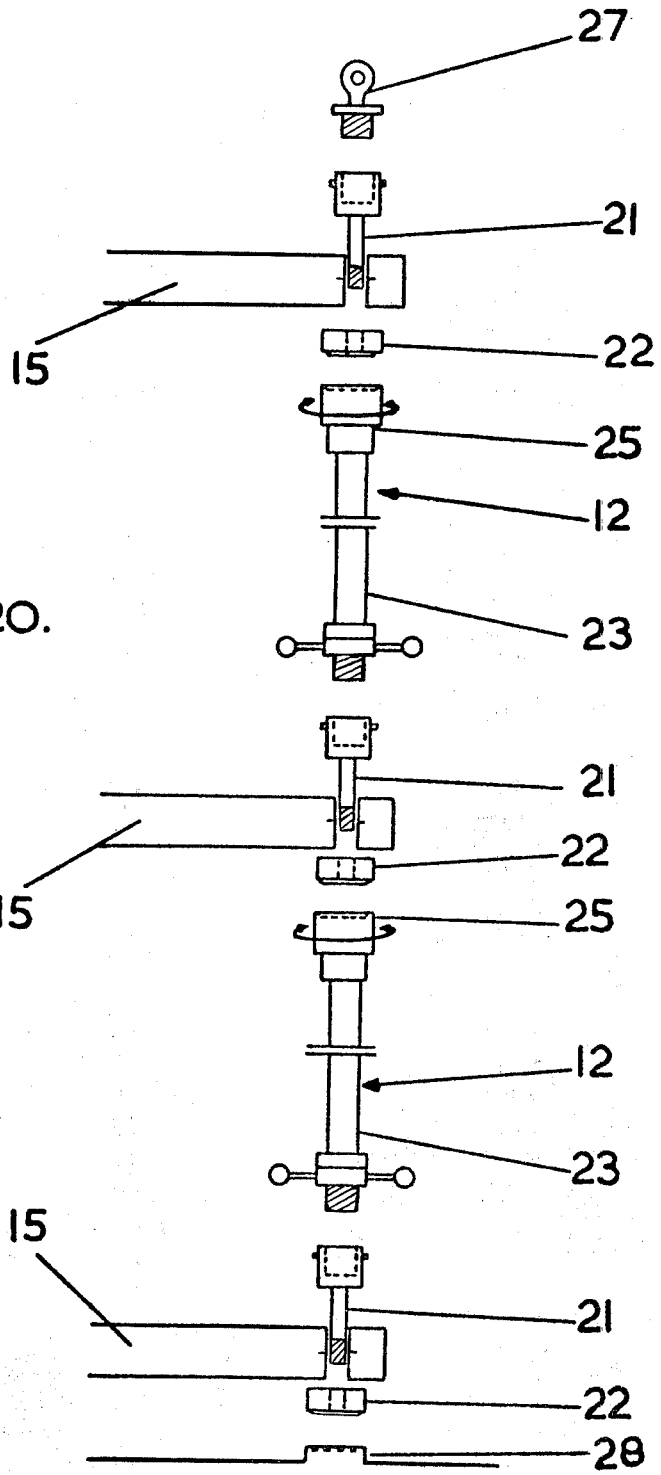

Turning now to FIGS. 18 and 20, the temporary support 12 utilised at each location where a column is omitted comprises a mandrel 21 which extends through the floor panel 15 and is screwed into a bearing disc 22, a column 23 which is adjustably screwed into a socket 24 at the top end of mandrel 21, a socket member 25 on the top end of column 23 and consisting of two relatively rotatable parts 25*a*, 25*b*, whereof the part 25*b* is provided with an attachment 26 for releasable connection to the roof or ceiling panels 16, and a lifting eye 27 removably screwed into the top end of socket member 25. It will be appreciated that this temporary connection rigidly holds the floor panel 15 and the roof or ceiling panel 16 in their correct relation at a location which is void of a column and that its vertical height may readily be adjusted so as to ensure the proper overall height of the room element at the said location. Thus if the main structure of each room element is prefabricated by means of a jig as in British Specification No. 1,109,873, the height of the temporary support connection 12 may be adjusted to meet the requirements of the jig. It may be mentioned that in manipulation of each room element (e.g. loading into and off a transport vehicle, and lifting into position in a building under construction) the lifting effort is applied to the eye or eyes 27 and to other lifting attachments provided on the upper ends of columns 11. Bearing disc 22 corresponds to a bearing pad provided below each column 11 and part 25*b* corresponds to a bearing pad at the top of each column 11.

In assembling the room elements of the lower storey, the bearing discs 22 (and the corresponding bearing pads) rest on the foundations 28. The lifting eyes 27 of the room elements are then removed, a room element of the next upper storey is then lowered on to each room element of the lower storey so that its bearing disc 22 sits on the part 25*b* of the temporary support 12 in the lower storey. This method of assembly continues storey-by-storey. When the room elements of all storeys have been assembled, permanent reinforcing elements are provided between the open-sided and open-ended room elements of each upper storey at substantially the locations occupied by the temporary supports 12 and the supports 12 removed from that upper storey. Next, the permanent reinforcing elements are provided in the next lower storey and the temporary supports 12 of the lower storey removed and these operations continue storey-by-storey down to the bottom storey. The temporary supports are returned to the factory for re-use, with the exception of the bearing discs 22 of the bottom storey which remain in situ so as to assist in supporting the building from the foundations 28.

It will be understood that prior to the removal of a temporary support 12, its part 25*b* is released from the roof or ceiling panel 16, and prior to this release the roof or ceiling panel is provided, at this location, with a permanent support by for example attaching it to the floor panel of a superimposed room element or by attaching it to the roof or ceiling panel of the adjacent room element.

It will be understood that while it is preferred to incorporate the roof or ceiling 16 in each room element during manufacture at the factory, it is within the scope of the invention to add the roof or ceiling at a later stage e.g., at the building site, or to utilise the floor panel 15 of each upper room element as the roof or ceiling of the lower room element on which it stands. In each of these arrangements it is still necessary to provide a temporary support 12 at each location where a column is omitted, and this temporary support is affixed to the floor panel 15 at the factory.

Figure 4:
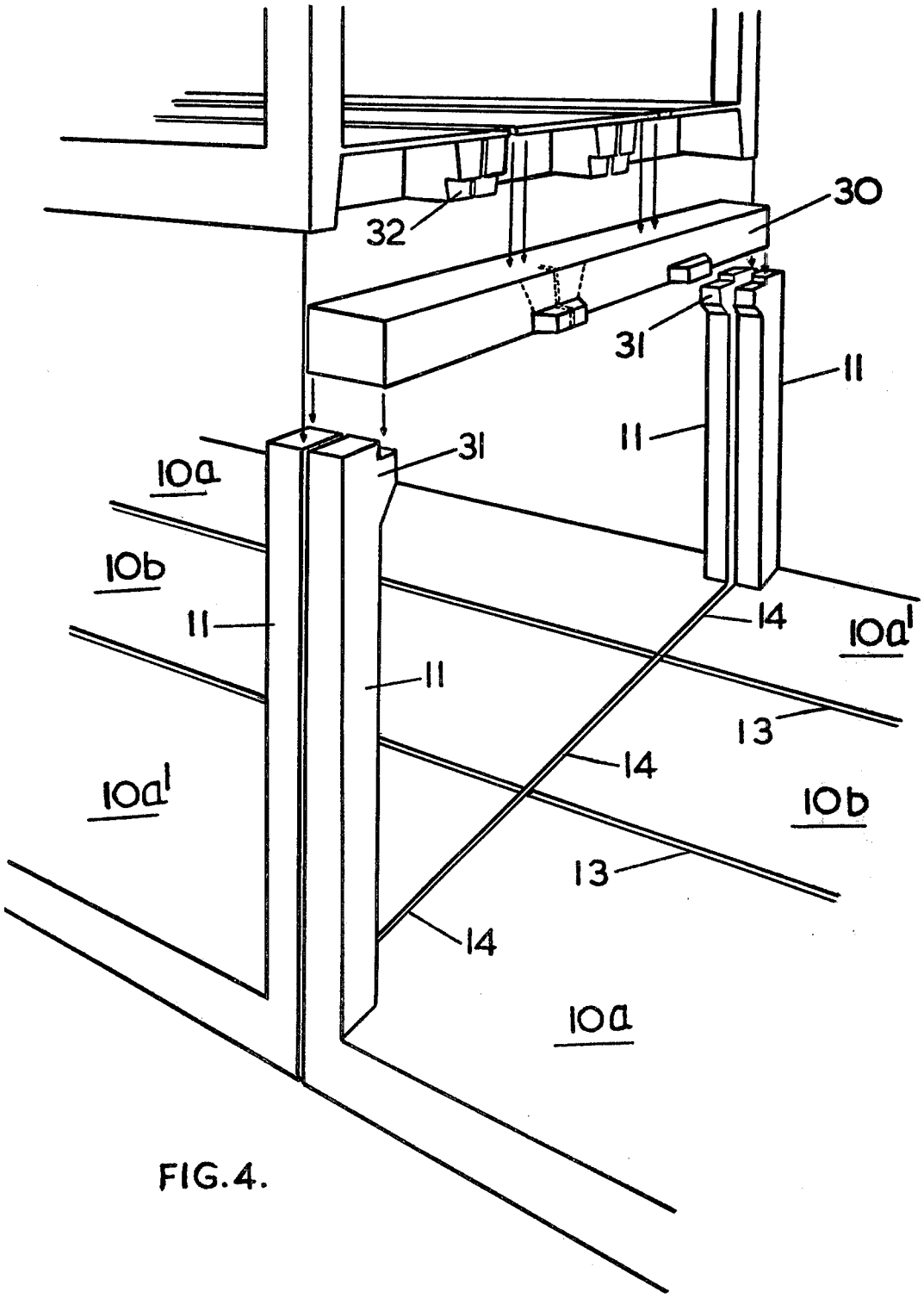

FIG. 4 illustrates one way in which the permanent reinforcing element can be provided to support the corners of the floor panels of an upper room element in an instance in which these corners are not supported by columns 11 of the lower room elements. A reinforced concrete beam 30 spans the space between the two pairs of columns 11 and rests on shoulders 31 thereon and shoulders 32 on the ends of the ribs at the underside of the superimposed floor panels rest on this beam. The ends of the beam may be fixed to the columns 11 in any suitable way; for example, by embedding protruding ends of reinforcement rods of the beam in a mass of quick-setting adhesive applied to the columns. The beams 30 cannot be placed in position until the temporary supports 12 have been removed (unless the temporary supports are off-set from the locations to be occupied by the beams) and the superimposed room elements cannot be placed in position until the beams 30 of the lower room elements are in position. This proceeds, storey by storey, from the bottom storey to the top.

Figure 5:
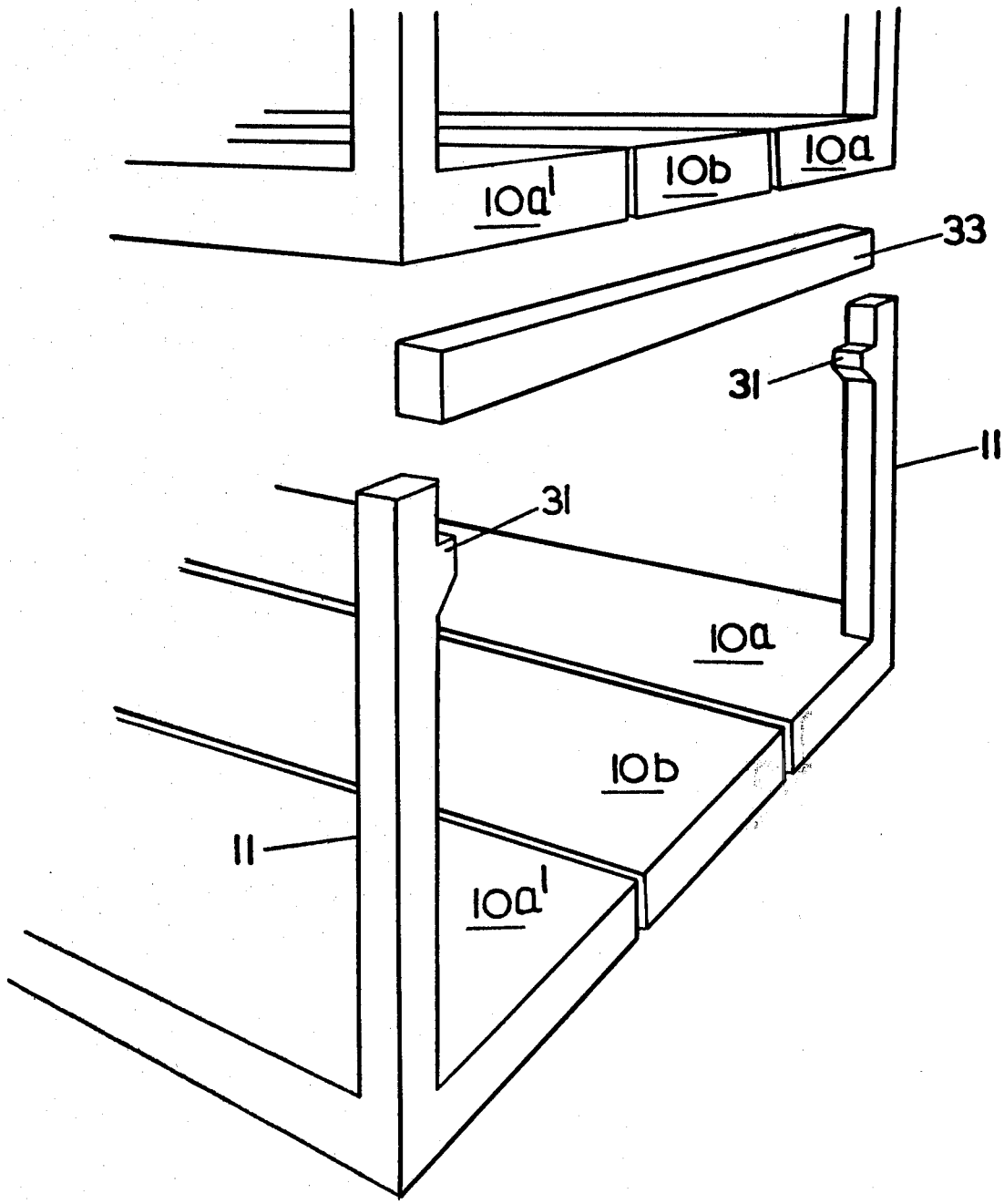
Figure 6:
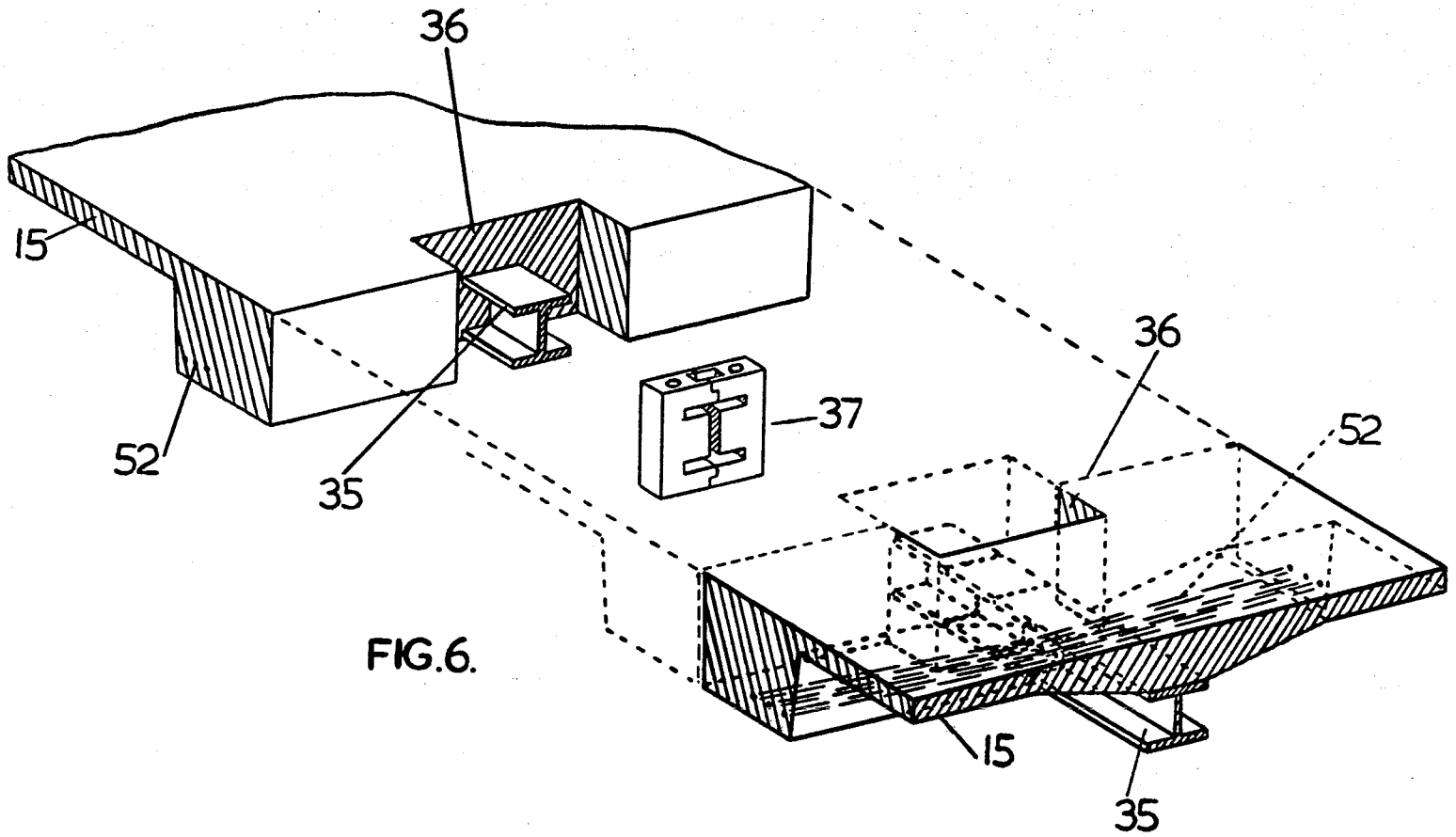
Figure 7:
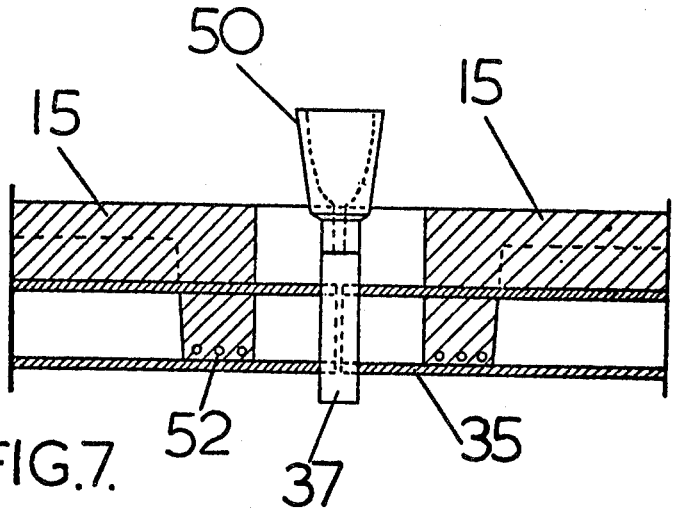
Figure 8:
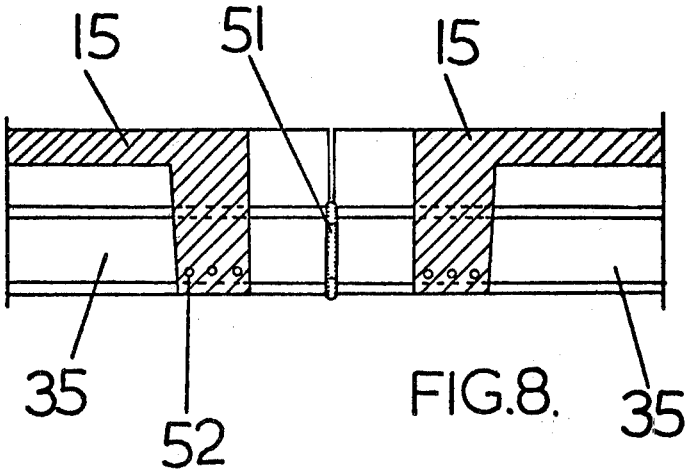
Figure 9:
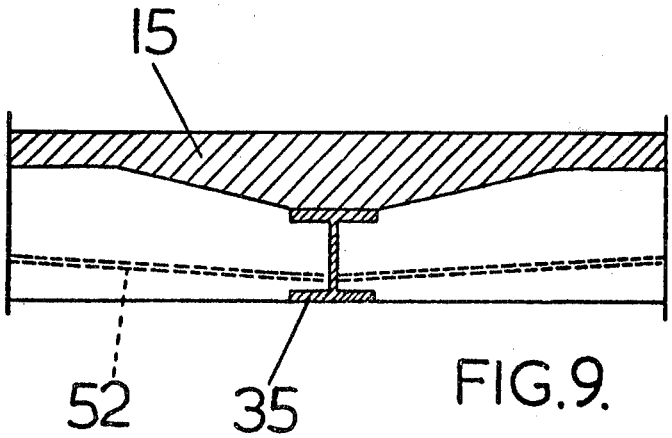

FIG. 5 shows a modification in which the space between a pair of columns 11 is spanned by a beam 33.

In the construction shown in FIGS. 6–9, each floor panel 15 contains a cast-in metal beam or joist 35, extending width-wise of it, an end of which beam is exposed within a recess 36 in the side margin of the floor panel. When two such floor panels are brought edge-to-edge, the ends of their beams register. These registering ends are enclosed in the two parts of a refractory mold 37, which is secured in position within the recesses and welding metal formed by a thermite process is admitted to this mould 37 from a crucible 50 so as to weld the end of the two beams together. The weld between the two beams 35 is shown at 51 in FIG. 8. The longitudinal reinforcement rods, or pre-stressing cables, 52 extend through the beams.

Figure 10:
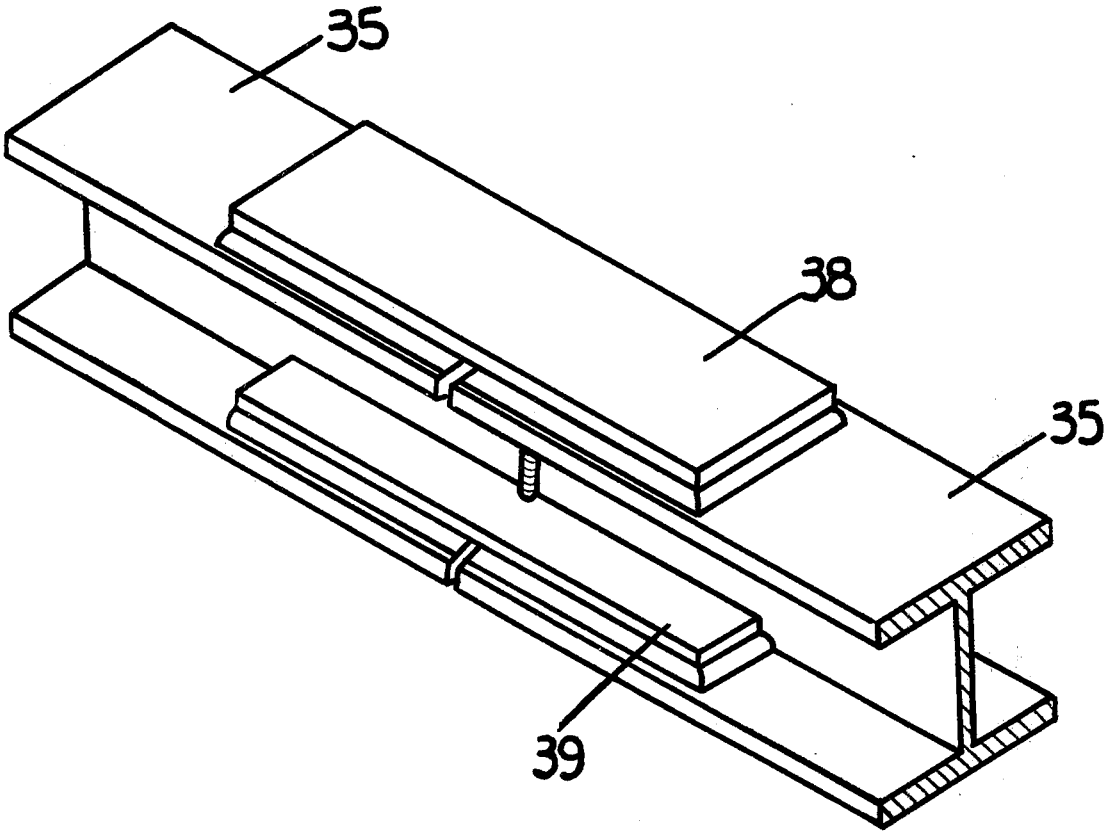

FIG. 10 shows a modification in which the registering ends of the two beams 35 are united by welded-on fish plates 38, 39. This necessitates that the recesses 36 be sufficiently large to permit the welding to be carried out.

It may here be mentioned that in the finished building the openings formed by the recesses 36 are filled by a suitable filling.

Figure 21:
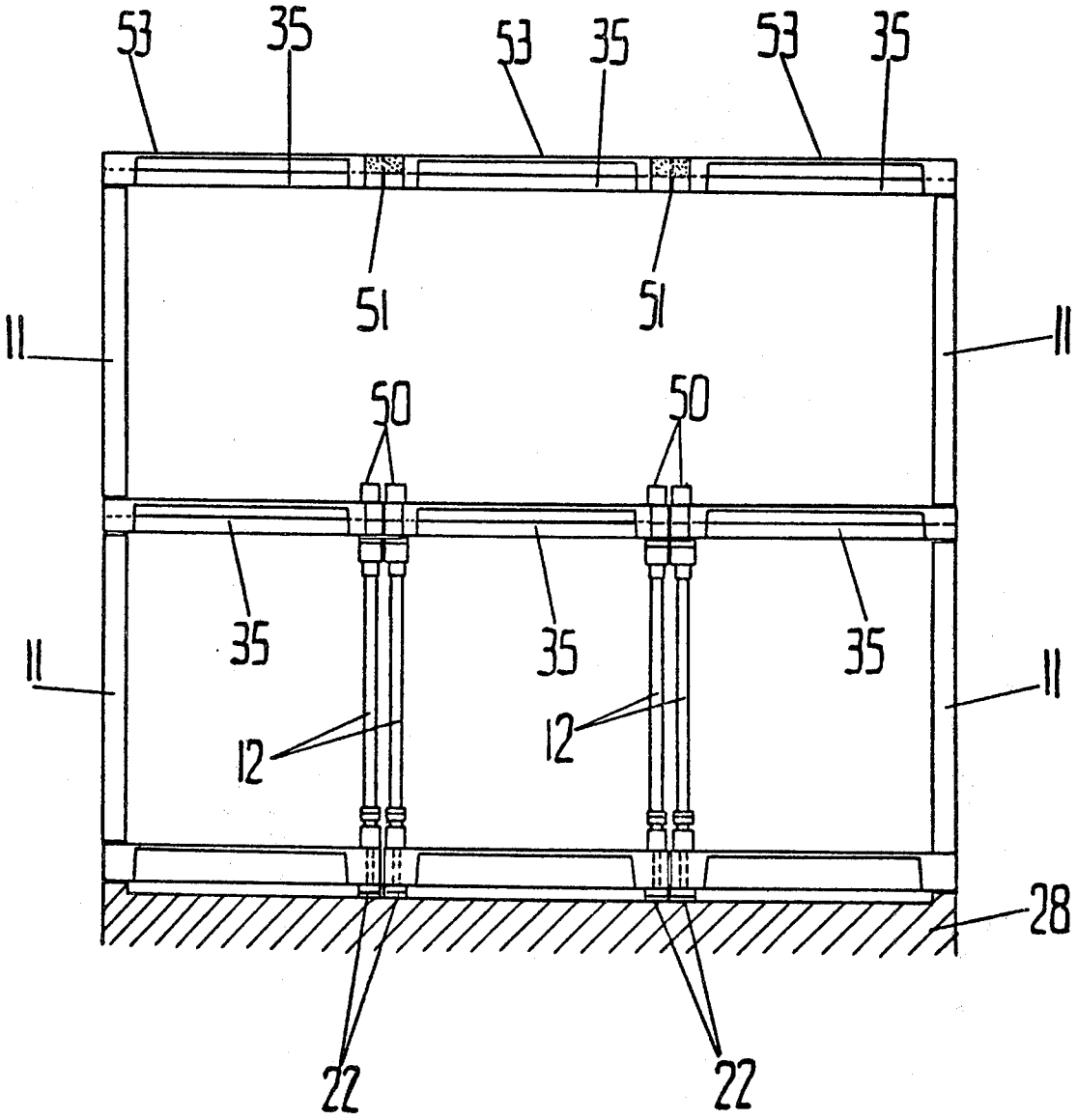

Referring to FIG. 21, which shows two storeys of a building with the temporary supports 12 still in situ in the lower storey but removed from the upper storey after the beams 35 of the pre-stressed reinforced concrete roof slabs 53 (resembling floor panels 15) have been welded together at 51. The crucibles 50 for welding together the beams 35 of the floor panels of the upper room elements are shown in situ; supports 12 will be removed after this last-mentioned welding has been effected.

FIG. 21 is intended to illustrate the retention of the temporary supports 12 in a storey until after the reinforcing elements of the superimposed floor panels (or roof panels) have been provided, irrespective of which of the particular arrangements of the floor panels shown in FIGS. 2A–2I is adopted.

Figure 11:
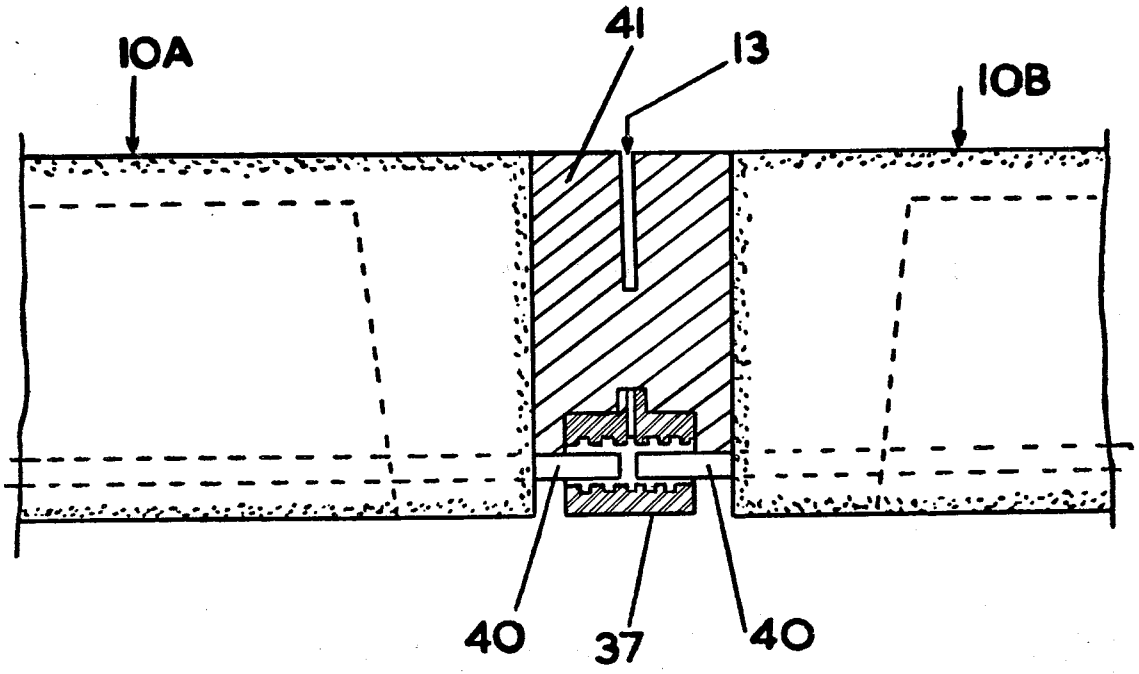

FIG. 11 shows a construction in which width-wise reinforcement rods of the floor panels, such for example as 10*a*, 10*b* have registering ends 40 which protrude at recesses 36. These recesses provide access to the rod-ends 40 and the steel sleeves 37′. In assembly, a sleeve 37′ is placed on a rod-end within the recess of one floor panel and, when the other floor panel has been placed in position, this sleeve is slid part-way across the joint to receive the other rod end. The molten metal of the thermite process is channelled into these sleeves to bond the ends of the rods together. The recesses 36 and the gap at the joint 13 are filled with mortar or quick-setting adhesive. The rods carry the tensile forces and the mortar the compressive forces. The mortar must set before the temporary supports are removed.

Figure 12:
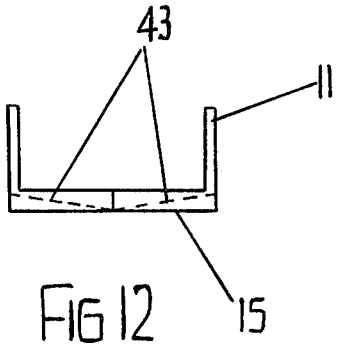

FIG. 12 illustrates the permanent connection by post-stressing between the floor panels 12 of two adjacent room elements 10*a*, 10*b* the stressing cables being indicated at 43. These cables extend through the floor panels and when two of the open-faced room elements have been assembled face-to-face at the building site, the pre-stressing cables of the two elements are themselves permanently connected so as to stress the two elements of the assembly together. The cables are desirably arranged as illustrated in FIG. 12 so that the post-stressing operation provides the proper degree of structural action at each point and assists in transmitting vertical shear stresses.

Figure 13:
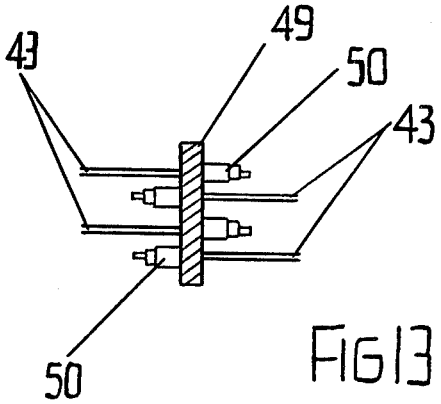
Figure 14:
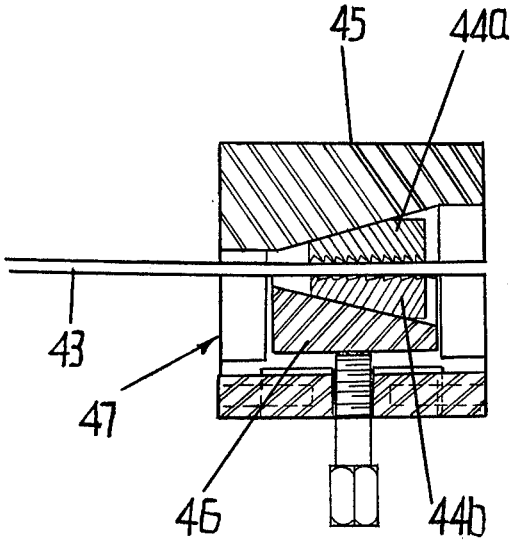
Figure 15:
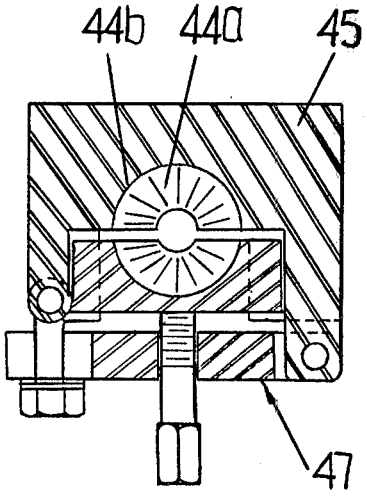
Figure 19:
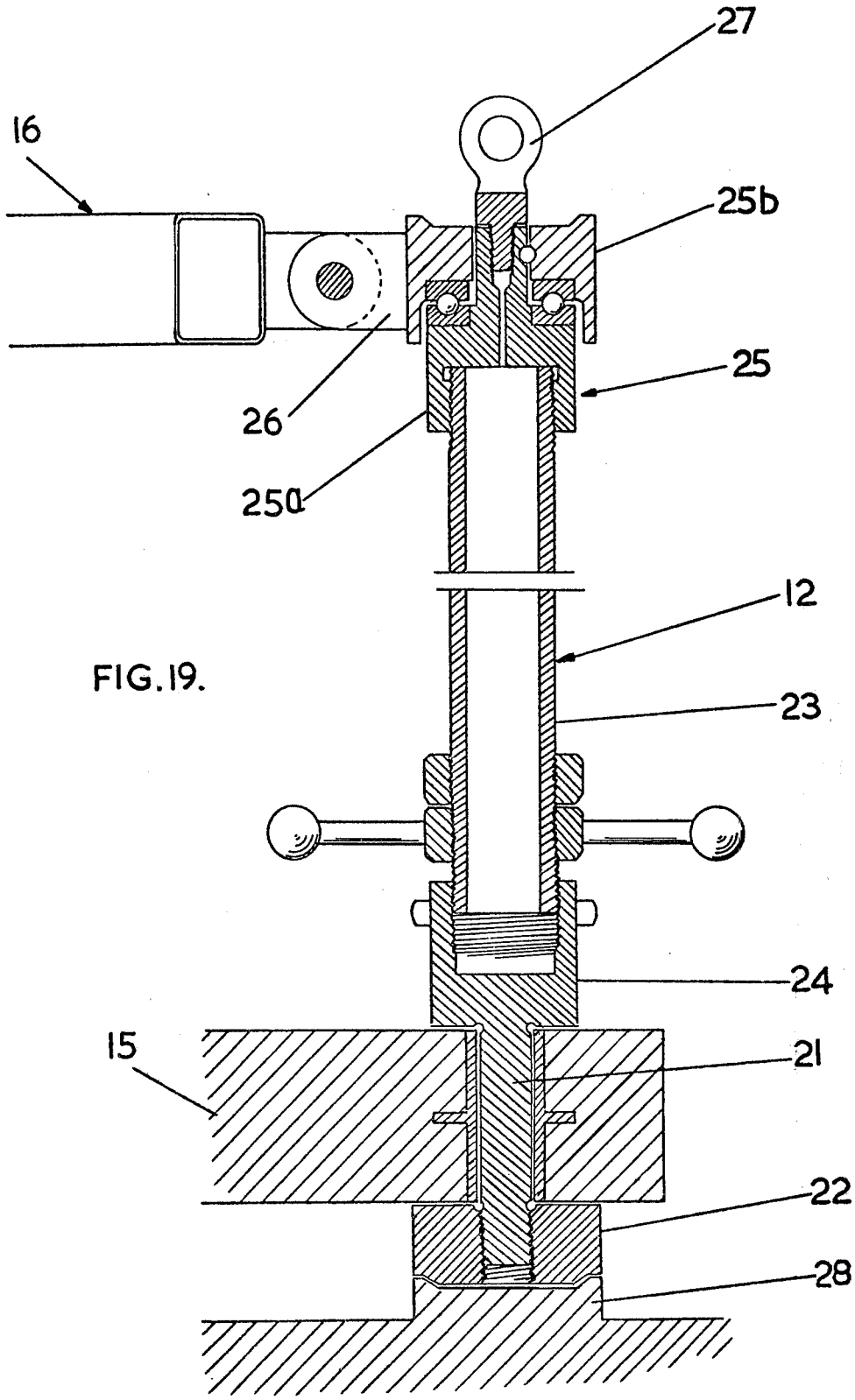

In the pre-stressing operation one end of each cable has a permanent anchorage at one side of the room element and its other end has a temporary anchorage at the other, and open, side of the room element, and the cable protrudes beyond this temporary anchorage to an extent sufficient for it to be joined to a similar cable of the adjacent room element in the post-stressing operation. The permanent anchorage may consist of the known split collet arrangement, in which the cable is received within and gripped by two tapered collets which are wedged in a surrounded sleeve or the like engaging or embedded in the floor panel. A temporary anchorage is illustrated in FIGS. 14 and 15, in which the two halves of a split collet are indicated at 44*a*, 44*b* and are held between two tapered clamp portions 45, 46 of a clamp indicated generally at 47. In the pre-stressing operation each cable 43 is tensioned to a slightly greater extent than is normally required and is held under tension by the clamp 47 which engages a suitable face of the floor panel. In the post-stressing operation the protruding ends of the cables 43 of the two adjacent room elements are passed through an anchor member 49 (FIG. 13) and permanently anchored to it by anchor devices 50, for example the split collet type. The temporary anchorages provided by the clamps 47 are then released (by permitting the clamping members 46 to open in relation to members 45), so that the two sets of cables are connected in tension by the anchor member 49.

The reinforcing elements such as are shown in FIGS. 14–15 are so positioned as to extend across the joints 13 (and/or 14).

Post stressing wires or cables 43 may be introduced after a plurality of the room elements have been assembled face-to-face, as illustrated in FIGS. 16–18. The floor panels of adjacent room elements are formed with a transverse duct 55 with a flared portion 56 or 56′ at each end. The wires are fed through this duct end and at one end are spaced apart by a rubber insert 57. At that end they pass through a ring 58 and through holes in an anchorage plate 59 being secured by split collets 60 and sleeves 61 in known manner. Ring 58 and plate 59 bear against a suitable face on the floor panel.

At the other end the wires 43 are held apart by a rubber insert 57′ and then pass through a pressure plate 58′ and an anchorage plate 59′ similar to parts 58, 59. Split collets and sleeves are threaded on to each wire and each wire is then tensioned by a jack 60 in known manner while its split collet and sleeve is moved against the outer face of the pressure plate 59′. When the wires have been tensioned and anchored the surplus protruding ends may be cut off and the duct is filled, with mortar injected into it through a canal 61 which is also provided with air vent 62. In order to prevent the injected mortar from escaping at the joint 13, a plastic sleeve is provided to close the conduit at this location. At the joint 13 between adjacent faces of the floor panels, either mortar 63 is dry packed between these faces after the room elements have been placed in situ or their accurate location is determined by steel pads 64, 64′ presented at their upper and lower edges and connected to the reinforcement of the panels. Metal reinforcements of the panels are shown at 65 and 66 in FIGS. 17 and 18.

Figure 22A:
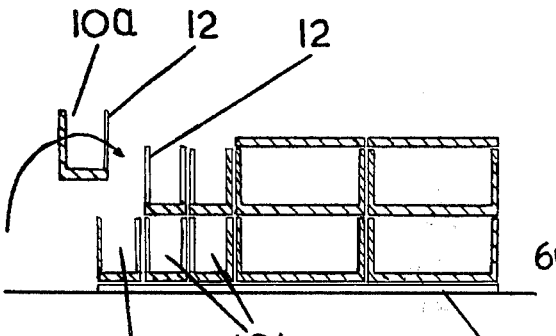
Figure 22B:
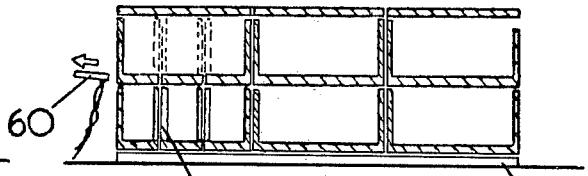
Figure 22C:
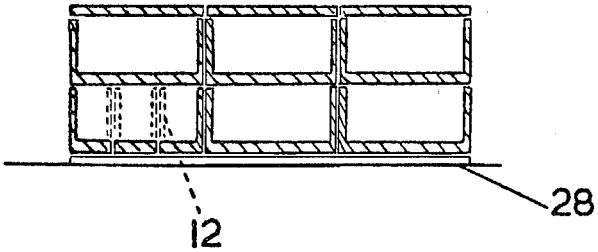

FIGS. 22A–22C show stages in the construction of a building according to this invention.

The room elements are transported on lorries from the factory to the building site and are there lifted from the vehicles and stacked on the foundation one upon another in any appropriate arrangement as illustrated in FIGS. 2A–2I. For example in each storey each stack may consist of a group of six room elements mounted side-by-side. In its right-hand portion FIG. 22A shows two completed stacks after the post-tensioning has been completed, and in its left-hand portion it shows a further stack being built up with the temporary supports of the various room elements still in position. In the left-hand part of FIG. 22B the temporary supports 12 of the upper storey of this further stack are shown in dotted lines to indicate that they have been, or are about to be, removed subsequent to the post-tensioning of the superimposed roof panel or floor panel. The operation of post-tensioning the floor panels of the upper storey by means of jack 60 is diagrammatically indicated, it being observed at this stage that these floor panels are still supported by temporary supports 12 from the floor panels of the room elements comprised in the lower storey. These lower floor panels do not require to be post-tensioned together. In FIG. 22C these supports 12 in the lower storey are shown dotted to indicate that they have been, or are about to be removed, subsequent to the post-tensioning of the floor panels of the superimposed room elements.

Figure 23A:
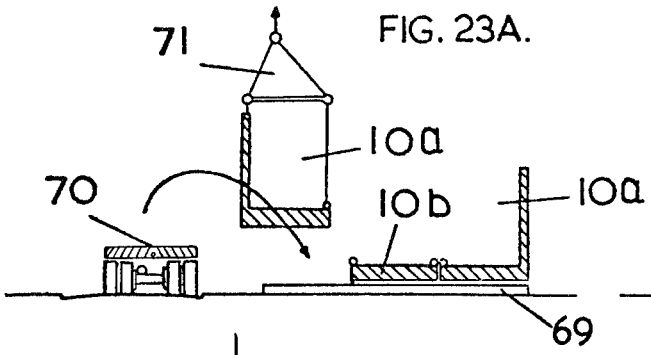
Figure 23B:
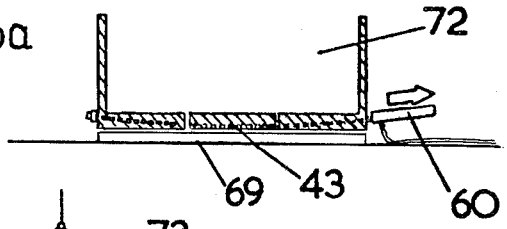
Figure 23C:
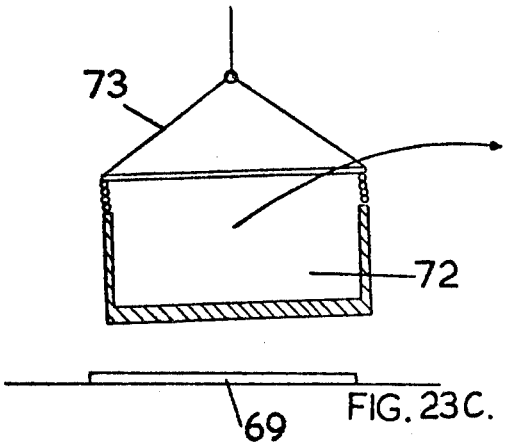
Figure 23D:
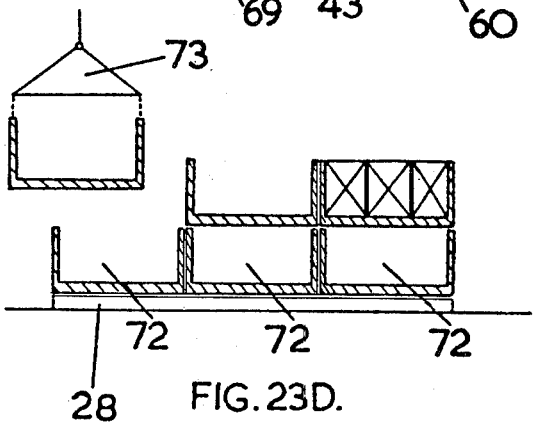

FIGS. 23A–23B illustrate a modified procedure in which the required group of room elements for a storey is built up upon a support surface or assembly platform 69. FIG. 23A shows the transport vehicle 70 and shows one of the room elements being removed from it to the platform 69 by lifting tackle 71. When three room elements have been assembled side-by-side as in FIG. 23B they are provided with the widthwise-extending reinforcing element by being post-tensioned together by wires 43 and jacks 60 so that the three initially-separate room elements now can jointly form a unit. This unit 72 is lifted by lifting tackle 73 and is placed in position in the being-erected building. It will be understood that the units 72 comprised in the ground floor stand on the foundations 28 while the units-comprised in the next upper floor stand on the lower floor units and so on. In this procedure the temporary supports are not employed, except to support the roofs or ceilings.

Figure 24:
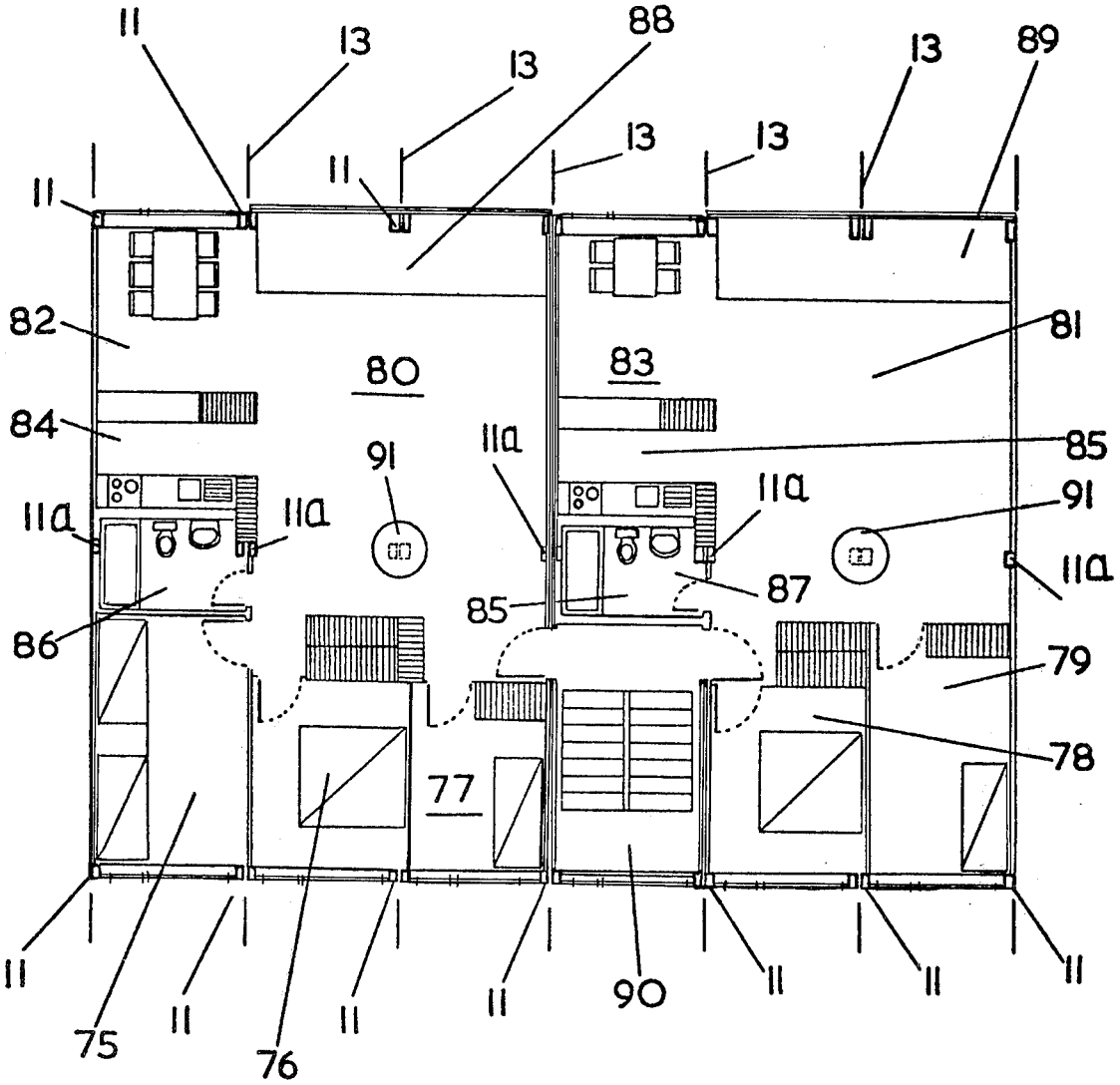

FIG. 24 is a plan of an apartment building, the left-hand apartment having three bedrooms 75, 76 and 77 and the other apartment having two bedrooms 78, 79. Each apartment has a living room 80 or 81, a dining room 82 or 83, kitchen 84 or 85, bathroom and toilet 86 or 87, and balcony 88 or 89; the two apartments have a joint entrance hall 90.

Each apartment can consist of three long room elements, one room element having four corner columns 11 and two intermediate column 11*a*, and two room elements as shown in FIG. 1E which are each void of the intermediate columns. Locations at which these were the last-mentioned intermediate columns would appear (if they were not omitted) are marked 91, and it will be seen that since these intermediate columns are not provided at locations 91, two of the room elements provide an unimpeded floor area.

Alternatively each apartment can consist of a group of six of the shorter room elements whereof two room elements have a column at each of the four corners and the other four room elements are void of a corner column as shown in FIG. 1A. The columnless corners of these four room elements meet at the location 91.

What is claimed is:

1. A building comprising a lower storey having an open floor area that is free of vertical load-bearing structure and having permanently preinstalled spaced-apart vertical load-bearing structures rigidly secured to and located at the perimeter of the open floor area at positions opposite each other, and an upper storey having at least two adjoining transportable prefabricated room elements, each of which includes a structural floor panel having a peripheral face that is in abutting relation to a face of the floor panel of the other room element to form a joint between adjacent floor panels, the floor panels of said adjoining elements overlying the open floor area of the lower storey and being supported at their respective perimeters by the vertical load-bearing structures of the lower storey and having reinforcing means spanning the upper storey floor panels and extending between said oppositely-positioned vertical load-bearing structures of the lower storey and bridging the joint, the reinforcing means including a metal beam constructed into each panel and registering end-wise with a like beam in the other panel and means for rigidly connecting the beams end to end and providing beam action in sustaining associated stresses across the joint and carrying panel loads over the open floor area of the lower storey and into the said oppositely-positioned vertical load-bearing structures of the lower storey.

2. A method of constructing a building comprising the steps of prefabricating at a location other than the building site at least two prefabricated room elements, each of which has a rectalinear structural floor panel having a perimeter that defines not less than one complete basic structural bay of the building and having an open face that is devoid of permanent vertical load-bearing structure and at least one permanently preinstalled load-bearing structure at a face opposite the open face, the load-bearing structures of the respective room elements being located on the respective floor panels thereof such that upon placing the room elements adjacent each other with the open faces of the floor panels thereof meeting at a juncture, the floor panels form an open floor area that is devoid of permanent vertical load-bearing structure and is of an expanse equal to an integer multiple of the basic structural bay of the building and the respective vertical load-bearing structures are located at the perimeter of the open floor area in positions opposite each other on a horizontal axis perpendicular to the junction between the floor panels, transporting the room elements to the building site, at the site mounting the room elements with their open faces abutting at a juncture to form an open floor area that is devoid of permanently-preinstalled load-bearing structure and is of an expanse equal in extent to an integer multiple of the basic structural bay of the building and with their load-bearing structures opposite each other at the perimeter of the open floor area and in a vertical plane perpendicular to said juncture, mounting at least two structural panels in overlying relation above the open floor area on the vertical load-bearing structure of the room element with faces of the two structural panels abutting each other to form a joint located in a vertical plane that includes the juncture between the floor panels of the room elements, and installing permanent reinforcing means for the structural panels to bridge the joint in a region extending between the vertical load-bearing structure and in said vertical plane and provide beam action in sustaining associated stresses across the joint and carry loads of said structural panels across the open floor area and thus across said integer multiple of the basic structural bays of the building and into the load-bearing structure of the room elements.

3. A method according to claim 2 wherein the at least two room elements form part of a storey of the building other than the uppermost storey, and wherein the said structural panels in overlying relation above the open floor area are structural floor panels of prefabricated transportable room elements of another storey of the building.

4. A method according to claim 2 wherein the at least two room elements form part of an uppermost storey of the building and said structural panels are part of a roof structure of the building.

5. A method according to claim 2 and further comprising the step of temporarily supporting the structural panels with temporary vertical support elements in the region of the joint between them during and after mounting the structural panels and at least prior to installing the permanent reinforcing means, and thereafter removing the temporary vertical support elements.

6. A method according to claim 2 and further comprising the steps of providing each open-faced room element, during construction of the latter, with a temporary vertical load-bearing support standing on its floor panel at a location, in a margin of the panel, which is devoid of any load-bearing structure aforesaid, retaining the temporary supports in position during transport of the room elements to the building site and removing the temporary support after the permanent reinforcing means has been installed.

7. A method according to claim 6, wherein said temporary support is provided substantially at the location to be occupied by the reinforcing means.

8. A method according to claim 6, wherein the temporary support is provided at its upper end with an attachment for releasable connection to a panel thereabove to support the latter from the floor panel.

9. A method according to claim 6, wherein the room elements are assembled face-to-face on a support surface, their floor panels are connected by the reinforcing means, and the room elements are then removed as a unit from the support surface, and deposited in the required location in the building under construction.

10. A building comprising at least two prefabricated transportable room elements, each of which includes a rectalinear structural floor panel having a perimeter that defines not less than one complete basic structural bay of the building, the two room elements being positioned adjacent each other with their floor panels meeting at a juncture and together defining an open floor area that is free of vertical load-bearing structure and is of an expanse equal in extent to an integer multiple of said basic structural bay, and each of which further includes permanently preinstalled spaced-apart vertical load-bearing structures located exclusively at the perimeter of the open floor area, said structures being the sole vertical structural support means for a part of the building vertically above the open floor area and including two opposed permanently preinstalled vertical load-bearing structures located in positions opposite each other in a vertical plane perpendicular to the juncture between the floor panels, and adjoining horizontal structural panels overlying the open floor area, each of said structural panels being superposed over one of the floor panels of the room elements and abutting each other at a joint overlying the open floor area, the structural panels being supported by the perimeter load-bearing structures of the said at least two room elements, and reinforcing means spanning the structural panels and bridging the joint between them exclusively at a narrow region centered substantially on said vertical plane and extending between the two opposed structures and providing beam-like action in carrying loads of the structural panels over the open floor area of the said at least two room elements and thus across an integer multiple of the said basic structural bay of the building into the two opposed structures.

11. A building according to claim 10, wherein the at least two room elements form parts of an uppermost storey of the building and the said structural panels are parts of a roof structure of the building.

12. A building according to claim 10, wherein the at least two room elements form parts of a storey of the building other than the uppermost storey, and the said structural panels are floor panel components of prefabricated transportable room elements of another storey of the building.

13. A building according to claim 10 wherein there are four room elements, each of which has a preinstalled permanent vertical load-bearing structure locted at each of two corners and has a corner which is devoid of any vertical load-bearing structure, the four room elements being positioned adjacent each other with the corners thereof that are devoid of vertical load-bearing structure meeting.

14. A building according to claim 10 wherein there are two room elements, the floor panel of each of which is elongated such that it has two opposite shorter edges and two opposite longer edges, wherein each room element has a preinstalled permanent load-bearing structure rigidly attached to and located at each of the four corners of the floor panel thereof and along one longer edge intermediate the corners thereof, the other of the longer edges of the floor panels of the two room elements being devoid of any vertical load-bearing structure, the two room elements being positioned adjacent each other with the respective longer edges thereof that are devoid of vertical load-bearing structure meeting, and wherein said vertical plane includes the axes of said vertical load-bearing structures that are located along one longer edge intermediate the corners of the respective floor panels of said room elements.

15. A building according to claim 10 wherein there are at least three transportable prefabricated room elements, each of which has an elongated rectangular structural floor panel having two opposite shorter edges and two opposite longer edges and a preinstalled permanent load-bearing structure rigidly attached to and located at each of the four corners of the floor panels thereof, the floor panel of two of the three room elements having a preinstalled vertical load-bearing structure rigidly attached thereto and located thereon along one longer edge intermediate the corners thereof, the other of the longer edges of the four panels of the said two room elements being devoid of vertical load-bearing structure, and the third room element being devoid of vertical load-bearing structure along both longer edges, the three room elements being mounted adjacent each other with the longer edges thereof that are devoid of vertical load-bearing structure meeting and wherein the axes of the vertical load-bearing structures of said two room elements that are located along the one longer edge intermediate the corners thereof are located in said vertical plane.

16. A building according to claim 10 wherein there are at least four room elements, the floor panel of each of which is located has two opposite shorter edges and two opposite longer edges, three of the room elements being positioned side by side with the longer edges of their floor panels abutting each other, and the fourth room element being positioned along the ends of the said three elements with a longer edge of its floor panel abutting the shorter edges of the floor panels of said three room elements, wherein there are preinstalled permanent load-bearing structures rigidly attached to and located (1) at three of four corners of the floor panels of the outermost two of the three side-by-side elements, (2) at each of two corners at the ends of one shorter edge on the floor panels of the center of the three side-by-side room elements and (3) at all four corners of the said panel of the said fourth room element, the four room elements being devoid of vertical load-bearing structure apart from those above specified, the said three side-by-side room elements being positioned with the corners thereof that are devoid of vertical load-bearing structure meeting such that the open floor area is composed of the floor panels of all four room elements, and wherein the axes of the vertical load-bearing structures at the corners of said outermost two of the three side-by-side room elements at the corners thereof at the ends of the shorter edges that abut the longer edge of the floor panel of said fourth room element lie in said vertical plane.

17. A building according to claim 10, wherein the reinforcing means comprises a supporting beam extending across said joint.

18. A building according to claim 10, wherein the reinforcing means comprises a metal beam constructed into each panel and registering end-wise with a like beam in the other panel, and means for rigidly connecting the beams end to end.

19. A building according to claim 10, wherein the reinforcing means comprises means for tensioning adjacent floor panels together.

20. A building according to claim 10, wherein there are three room elements arranged side by side in adjacent relation, thusly to constitute a cluster consisting of an intermediate room element positioned between two outside room elements, each of the outside room elements of the three having a preinstalled permanent vertical load-bearing structure rigidly attached to and located at each of three corners of the floor panels thereof and being devoid of such a vertical load-bearing structure at one corner of the floor panel thereof, and the intermediate room element having preinstalled permanent load-bearing structures at two corners of the floor panel thereof and being devoid of such a structure at two corners of the floor panel thereof, the three room elements being positioned with the corners of the respective floor panels that are devoid of vertical load-bearing structure meeting.

21. A building according to claim 20, wherein each room element has two preinstalled permanent vertical load-bearing structures rigidly attached to and located along opposite edges of the floor panels intermediate of the corners thereof.

* * * * *

UNITED STATES PATENT AND TRADEMARK OFFICE

CERTIFICATE OF CORRECTION

PATENT NO. : 4,023,315

DATED : May 17, 1977

INVENTOR(S) : Fritz Christophe Stucky

It is certified that error appears in the above-identified patent and that said Letters Patent are hereby corrected as shown below:

Col. 2, line 10, "tension/forces" should read --tension and shear forces--;
Col. 3, line 42, "casting in" should read --cast-in--;
Col. 4, lines 21 & 22, delete "or first face";
Col. 5, line 16, "betweenn" should read --between--;
Col. 6, line 18, "18" should read --19--;
Col. 6, line 39, after "may" insert --here--;
Col. 11, line 57, "part" should read --parts--;
Col. 13, line 1, "locted" should read --located--;
Col. 13, line 47, after "located" insert --and--;
Col. 14, line 3, after "side-by-side" insert --room--; and
Col. 14, line 5, "on" should read --of--.

Signed and Sealed this

*thirtieth* Day of *August 1977*

[SEAL]

*Attest:*

RUTH C. MASON
*Attesting Officer*

C. MARSHALL DANN
*Commissioner of Patents and Trademark.*